US009593651B2

(12) United States Patent
Take et al.

(10) Patent No.: US 9,593,651 B2
(45) Date of Patent: Mar. 14, 2017

(54) FUEL-FILTER MALFUNCTION DETECTION DEVICE

(71) Applicant: DENSO CORPORATION, Kariya, Aichi-pref. (JP)

(72) Inventors: Hirofumi Take, Kariya (JP); Yoshio Toyoshima, Kariya (JP)

(73) Assignee: DENSO CORPORATION, Kariya (JP)

( * ) Notice: Subject to any disclaimer, the term of this patent is extended or adjusted under 35 U.S.C. 154(b) by 193 days.

(21) Appl. No.: 14/590,176

(22) Filed: Jan. 6, 2015

(65) Prior Publication Data

US 2015/0198125 A1 Jul. 16, 2015

(30) Foreign Application Priority Data

Jan. 14, 2014 (JP) ..... 2014-004257

(51) Int. Cl.
*F02M 51/00* (2006.01)
*F02M 37/22* (2006.01)
(Continued)

(52) U.S. Cl.
CPC ..... *F02M 37/22* (2013.01); *F02D 41/04* (2013.01); *F02D 41/22* (2013.01);
(Continued)

(58) Field of Classification Search
CPC ..... F02D 2200/0602; F02D 41/3845; F02D 2250/31
(Continued)

(56) References Cited

U.S. PATENT DOCUMENTS 6,032,639 A * 3/2000 Goto ..... F02D 41/222 123/295
7,481,919 B1 * 1/2009 Keenan ..... F02M 37/0047 210/110
(Continued)

FOREIGN PATENT DOCUMENTS

JP 2003-097379 4/2003
JP 2007138774 A * 6/2007
JP 2011-122518 6/2011

OTHER PUBLICATIONS

Office Action (2 pages) dated Feb. 16, 2016, issued in corresponding Japanese Application No. 2014-004257 and English translation (3 pages).

*Primary Examiner* — John Kwon
(74) *Attorney, Agent, or Firm* — Nixon & Vanderhye PC

(57) ABSTRACT

A fuel-filter malfunction detection device detects a clogging of a fuel filter when specified conditions are satisfied. In a clogging detection, a command discharge quantity to a high-pressure pump is increased more than a total of a fuel injection quantity and a leakage of the fuel supply system while a pressure-reducing valve is closed. When the fuel filter is clogged, a discharge quantity of the high-pressure pump is decreased relative to the command discharge quantity and a differential pressure is generated between an estimated common-rail pressure and an actual common-rail pressure. When an integrated moving average of the averages of the differential pressure is greater than or equal to a specified value, an ECU determines that the fuel filter has a malfunction. Then, a malfunction flag is turned ON.

2 Claims, 7 Drawing Sheets

(51) Int. Cl.

| | |
|---|---|
| ***F02M 37/00*** | (2006.01) |
| ***F02D 41/22*** | (2006.01) |
| ***F02D 41/04*** | (2006.01) |
| *F02D 41/38* | (2006.01) |
| *F02D 41/40* | (2006.01) |

(52) U.S. Cl.
CPC ..... *F02M 37/0023* (2013.01); *F02D 41/3845* (2013.01); *F02D 41/406* (2013.01); *F02D 2041/224* (2013.01); *F02D 2200/0602* (2013.01)

(58) Field of Classification Search
USPC ..... 123/446, 447, 456–458, 467, 510, 479, 123/690; 73/114.38, 114.43, 114.51; 210/85, 348
See application file for complete search history.

(56) References Cited

U.S. PATENT DOCUMENTS

| | | | | |
|---|---|---|---|---|
| 8,412,440 | B2 * | 4/2013 | Kaneko | F02D 41/222 123/456 |
| 2008/0065306 | A1 * | 3/2008 | Takahashi | B63H 20/00 701/101 |
| 2009/0056678 | A1 * | 3/2009 | Nakata | F02D 41/221 123/480 |
| 2010/0192910 | A1 | 8/2010 | Toyoshima | |
| 2013/0311067 | A1 * | 11/2013 | Stockner | F02D 19/027 701/104 |

* cited by examiner

FUEL-FILTER MALFUNCTION DETECTION DEVICE

CROSS-REFERENCE TO RELATED APPLICATION

This application is based on Japanese Patent Application No. 2014-4257 filed on Jan. 14, 2014, the disclosure of which is incorporated herein by reference.

TECHNICAL FIELD

The present disclosure relates to a fuel-filter malfunction detection device which detects malfunctions of the fuel filter arranged upstream of a high-pressure pump in a fuel supply system.

BACKGROUND

In a fuel supply system in which a high-pressure pump pressurizes a fuel and supplies the fuel to a fuel injector, a fuel filter is provided upstream of the high-pressure pump. The fuel filter removes foreign matters contained in the fuel. When the fuel filter is clogged with the foreign matters, an efficiency of filtration is deteriorated. A pressure loss is increased in the fuel filter, and a fuel flow rate may be decreased.

JP-2011-122518A shows a fuel supply system which is able to detect a malfunction due to a clogging of a fuel filter. Specifically, an electric current value flowing through an electric pump or a rotation speed of the electric pump at an idling state of an engine with no malfunction is compared to that with a malfunction. Based on the compared result, the system determines whether a malfunction exists or not.

In a fuel supply system in which an electric pump supplies the fuel to the high-pressure pump, a malfunction in a fuel filter can be detected based on the electric current value flowing through the electric pump or the rotation speed of the electric pump. However, even in a case that a fuel supply system does not have an electric pump, it is desired to detect a malfunction of the fuel filter.

SUMMARY

It is an object of the present disclosure to provide a fuel-filter malfunction detection device which detects a malfunction of the fuel filter based on a pressure of the fuel supplied to a fuel injector.

The fuel-filter malfunction detection device has a discharge control portion, a pressure obtaining portion, and a malfunction determination portion. The discharge control portion increases or decreases a discharge quantity of a high-pressure pump when a specified malfunction detection condition is established, The pressure obtaining portion obtains a fuel pressure from a pressure sensor arranged downstream of the high-pressure pump. The malfunction determination portion determines whether the fuel filter has a malfunction based on the fuel pressure obtained by the pressure obtaining portion, when the discharge control portion increases or decreases the discharge quantity of the high-pressure pump with the specified malfunction detection condition established.

When the fuel filter is clogged, an actual discharge quantity of the high-pressure pump is decreased more than a command discharge quantity. As a result, an actual fuel pressure obtained from a pressure sensor become lower than an estimated fuel pressure estimated based on the command discharge quantity.

Therefore, a malfunction of the fuel filter can be detected based on the fuel pressure detected by the pressure sensor.

BRIEF DESCRIPTION OF THE DRAWINGS

The above and other objects, features and advantages of the present disclosure will become more apparent from the following detailed description made with reference to the accompanying drawings. In the drawings.

DETAILED DESCRIPTION

Hereinafter, an embodiment of the present disclosure is described.

First Embodiment

Figure 1:
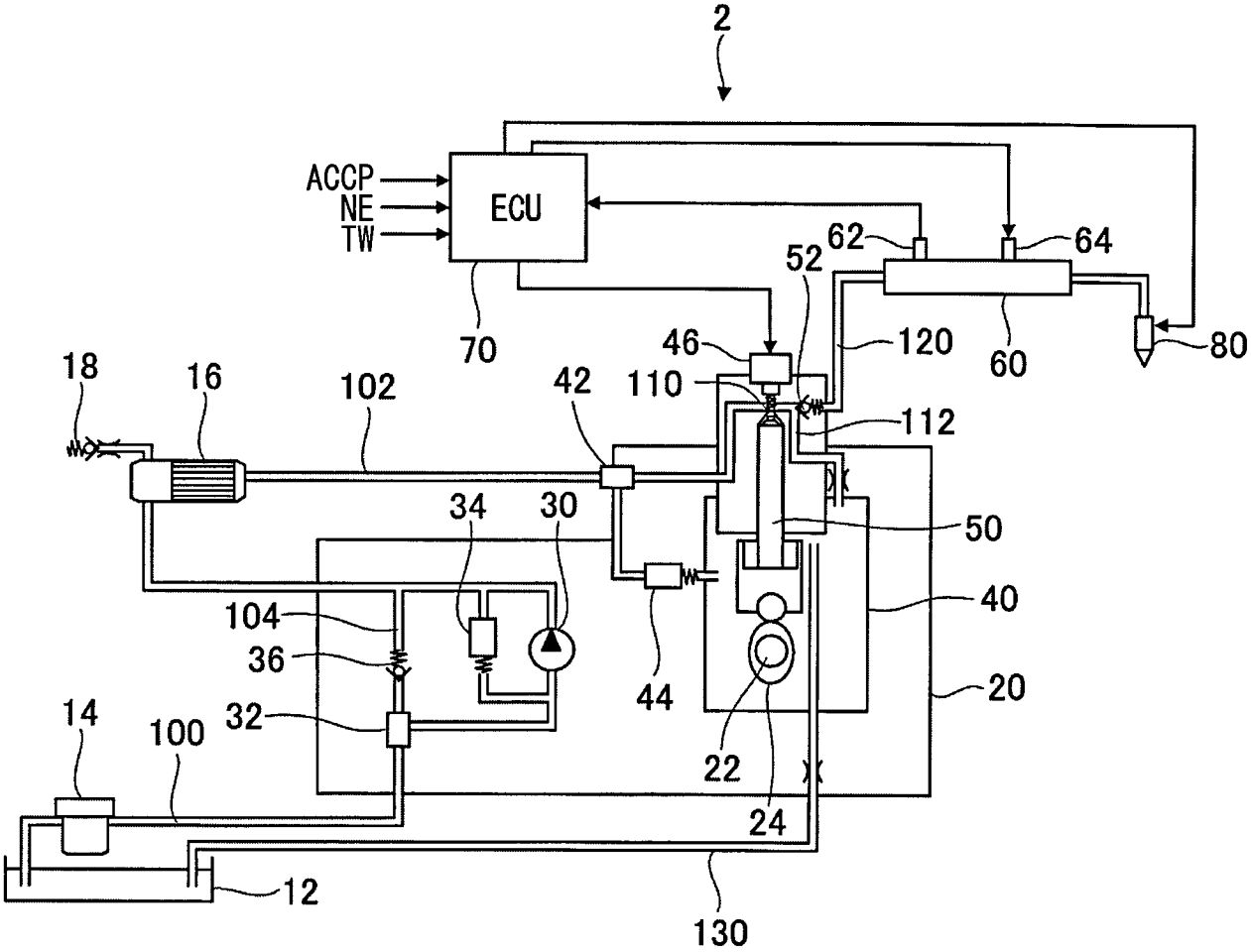
FIG. 1 is a schematic view showing a fuel supply system according to a first embodiment.

As shown in FIG. 1, a fuel supply system 2 supplies a fuel to a fuel injector 80 which is provided to each cylinder of a diesel engine (not shown). The fuel supply system 2 is provided with a fuel tank 12, fuel filters 14, 16, an air-bleeding valve 18, a fuel supply pump 20, a common-rail 60, a pressure sensor 62, a pressure-reducing valve 64 and an electronic control unit (ECU) 70. The fuel filters 14, 16 are arranged upstream of a high-pressure pump 40.

The fuel supply pump 20 has a feed pump 30 and a high-pressure pump 40. The feed pump 30 is a mechanical trochoid pump or a vane pump. The feed pump 30 and the high-pressure pump 40 are driven by a camshaft 22. The camshaft 22 is rotated by an engine crankshaft.

The first fuel filter 14 and a gauze filter 32 are arranged in a fuel passage 100 through which the feed pump 30 suctions the fuel from the fuel tank 12. These filters 14, 32 remove a foreign matter in a fuel before the fuel is suctioned into the feed pump 30. Since the first fuel filter 14 is arranged upstream of the feed pump 30, the pressure of fuel flowing through the first fuel filter 14 is negative pressure.

The first fuel filter 14 is provided with a differential pressure sensor (not shown). Based on an output signal from the differential pressure sensor, a clogging of the first fuel filter 14 is detected.

The gauze filter 32 is arranged downstream of the first fuel filter 14 for removing a foreign matter of large size in a fuel flowing through the fuel passage 100. Therefore, the gauze filter 32 has rough mesh than the first fuel filter 14. The pressure loss of the gauze filter 32 is smaller than that of the first fuel filter 14.

The second fuel filter 16 is arranged in a fuel passage 102 downstream of the feed pump 30, and removes a foreign matter in the fuel discharged from the feed pump 30. Since the feed pressure of the feed pump 30 is applied to the second fuel filter 16, the pressure of the fuel flowing through the second fuel filter 16 is positive pressure. A relief valve 34 is opened when the feed pressure of the feed pump 30 exceeds a predetermined pressure.

A priming pump (not shown) is connected to a bypass passage 104. When assembling a vehicle, the priming pump is driven so that the fuel is supplied to downstream of the feed pump 30 while bypassing the feed pump 30 through a check valve 36. When the priming pump is driven, the air in the fuel passage can be discharged from the air-bleeding valve 18.

A gauze filter 42 is arranged downstream of the second fuel filter 16 for removing a foreign matter of large size in a fuel flowing through the fuel passage 102. The gauze filter 42 has rough mesh than the second fuel filter 16. The pressure loss of the gauze filter 42 is smaller than that of the second fuel filter 16. A part of the fuel flowing through the gauze filter 42 is supplied to a cam box of the high-pressure pump 40 through a cam orifice valve 44 as lubricant.

A metering valve 46 is an electromagnetic valve which is fully opened in a suction stroke in which a plunger 50 of the high-pressure pump 40 slides down. A valve-closing time of the metering valve 46 is controlled in a feed stroke in which the plunger 50 of the high-pressure pump 40 slides up. When the metering valve 46 is closed, the plunger 50 slides up to pressurize the fuel in a pressurization chamber 110.

Therefore, the valve-closing time of the metering valve 46 is controlled in order to adjust the discharge quantity of the high-pressure pump 40. The plunger 50 is reciprocated by a cam 24 rotating with the cam shaft 22, whereby the plunger 50 pressurizes the fuel in the pressurization chamber 110 of the high-pressure pump 40.

When the fuel pressure in the pressurization chamber 110 exceeds a specified value, a discharge valve 52 is opened, whereby the fuel is supplied to the common-rail 60 through the fuel passage 120. A part of the fuel pressurized in the pressurization chamber 110 is supplied to the cam box through the fuel passage 112 as a lubricant. The surplus fuel in the cam box is returned to the fuel tank 12 through a fuel passage 130.

The common-rail 60 is an accumulator accumulating high-pressure fuel discharged from the high-pressure pump 40. The pressure sensor 62 outputs signals indicative of a fuel pressure in the common-rail 60. This fuel pressure in the common-rail 60 is referred to as a common-rail pressure. When the pressure reducing valve 64 is opened, the fuel in the common-rail 60 is discharged to reduce the common-rail pressure. The fuel accumulated in the common-rail 60 is supplied to each fuel injector 80.

The ECU 70 is mainly constructed of a microcomputer having a CPU, a ROM, a RAM, and flash memory. The ECU 70 receives detection signals from various sensors, such as the pressure sensor 62, an accelerator position (ACCP) sensor, an engine speed (NE) sensor, and a coolant temperature (TW) sensor. Based on the detection signals, the ECU 70 controls an engine operation condition.

The ECU 70 controls an energization of the metering valve 46 to adjust the discharge quantity of the high-pressure pump 40. Further, the ECU 70 controls the fuel injection quantity, the fuel injection timing of the fuel injector 80 and a multiple injection pattern in which the pilot injection before the main injection and the post injection after the main injection are performed.

(Clogging of Filter)

The fuel filters 14, 16 have a filter element respectively. The filter element has a fine mesh in order to remove a foreign matter of small size in the fuel. Thus, when the fuel contains a lot of foreign matters, it is likely that the first fuel filter 14, 16 are clogged with the foreign matters.

Figure 2:
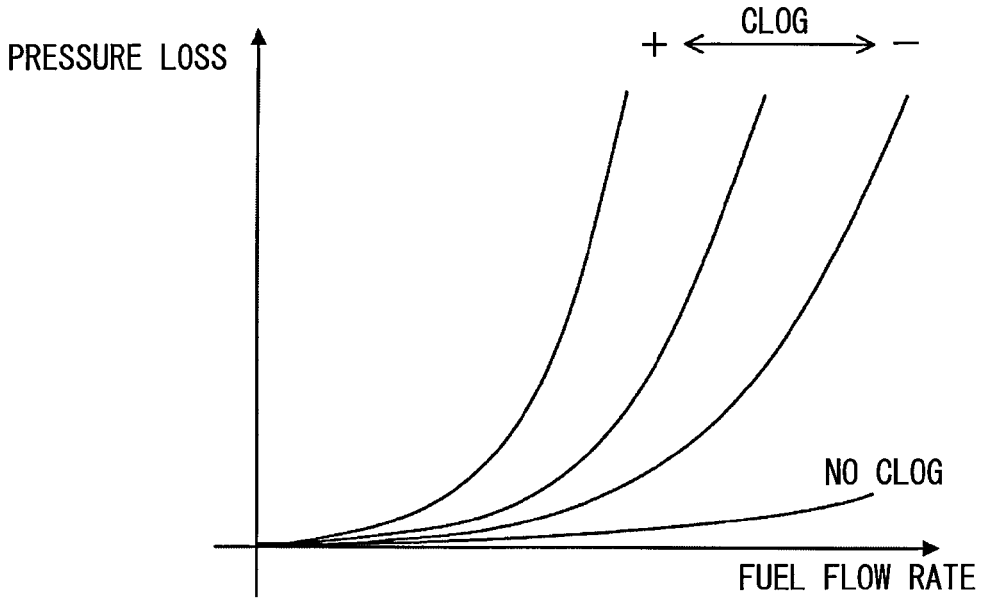
FIG. 2 is a characteristic chart showing a relationship between a fuel flow rate and a pressure loss.

As shown in FIG. 2, as the clogging of the filter is increased, the pressure loss in the filter is increased relative to the fuel flow rate. As a result, the removable quantity of foreign matters is decreased and the fuel flow rate flowing through the filters is decreased.

Therefore, in a case that the pressure loss of the fuel filters 14, 16 is increased, even if the valve-closing time of the metering valve 46 is controlled so that an actual common-rail pressure follows the target common-rail pressure, the fuel quantity supplied to the high-pressure pump 40 through the fuel filters 14, 16 is decreased.

Figure 3:
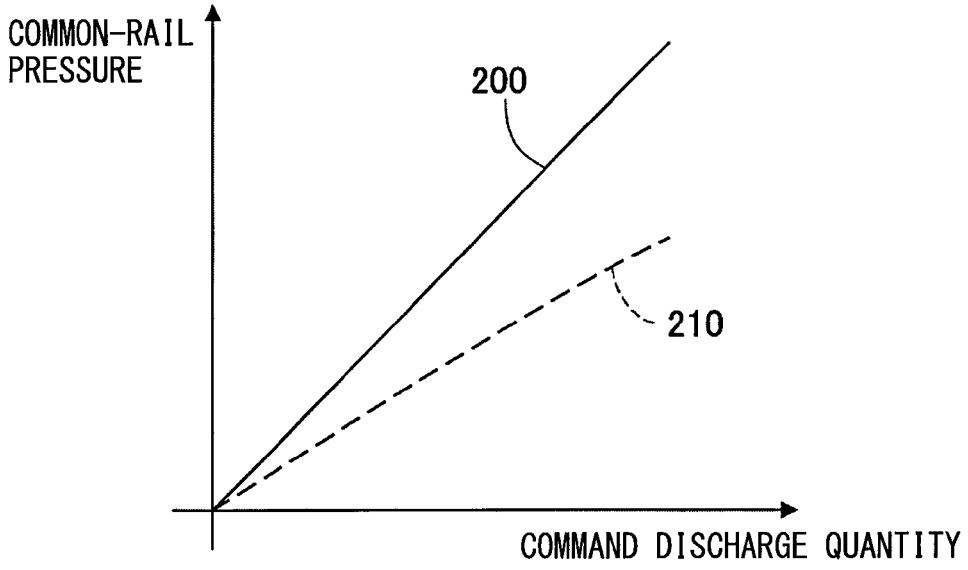
FIG. 3 is a characteristic chart showing a relationship between a command discharge quantity and a common-rail pressure.

As a result, the discharge quantity of the high-pressure pump 40 is decreased more than a command discharge quantity. FIG. 3 shows characteristics line 210 of a filter with a lot of clogs, and characteristics line 200 of a filter with little clogs. Regarding the filter shown by the characteristics line 210, the common-rail pressure (Pc) becomes lower than that shown by the characteristics line 200 relative to the same command discharge quantity.

(Malfunction Detection Processing)

A malfunction detection processing of the second fuel filter 16 will be described, hereinafter. The malfunction detection processing is executed by the ECU 70. Regarding the first fuel filter 14, a malfunction can be detected based on a differential pressure of the first fuel filter 14 according to another processing. When the first fuel filter 14 has a malfunction, the malfunction flag of the first fuel filter 14 is turned ON.

Figure 4:
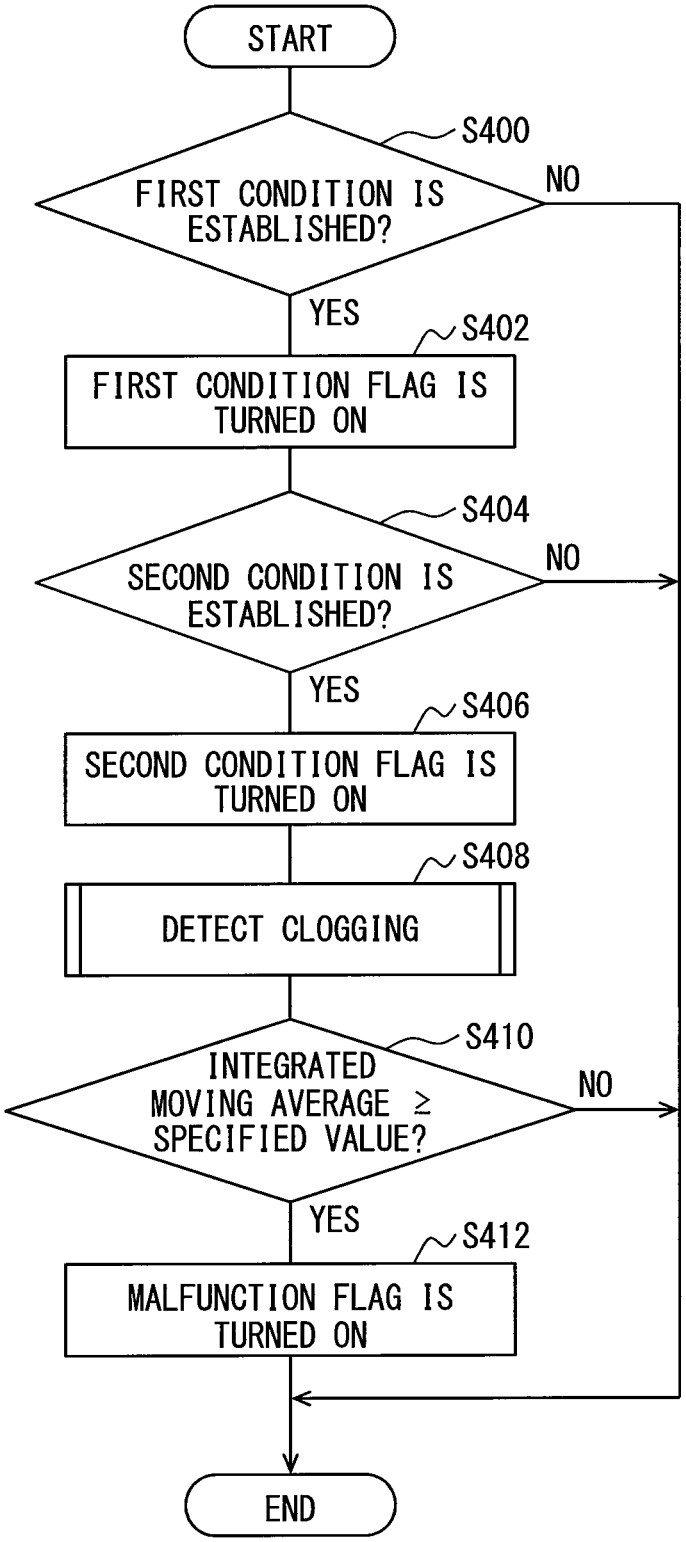
FIG. 4 is a flowchart showing a malfunction detection processing.

FIG. 4 is a flowchart showing the malfunction detection processing of the second fuel filter 16. In S400, the ECU 40 determines whether a first condition for executing the malfunction detection processing of the second fuel filter 16 is established. When all of the following conditions (1)-(5) are established, the ECU 70 determines that the first condition for executing the malfunction detection processing of the second fuel filter 16 is established. Each of the conditions (1)-(5) is detected by a processing other than the malfunction detection processing.

(1) An electric system driving the metering valve 46 is normal.

(2) An electric system driving the pressure-reducing valve 64 is normal.

(3) An electric system driving the fuel injector 80 is normal.

(4) An output of the pressure sensor 62 is normal.

(5) A leakage of the fuel supply system from the fuel tank 12 to the fuel injector 80 is less than a predetermined quantity.

When the first condition for executing the malfunction detection processing is not established (NO: S400), the ECU 70 terminates the processing. When the answer is YES in S400, the procedure proceeds to S402 in which a first condition flag is turned ON by the ECU 70. Then, the procedure proceeds to S404 in which the ECU 70 determines whether a second executing condition for detecting a malfunction of the second fuel filter 16 is established. When all of the following conditions (1)-(9) are established, the ECU 70 determines that the second executing condition is established. Each of the conditions (1)-(9) is detected by a processing other than the malfunction detection processing.

(1) The condition flag is ON.

(2) The engine speed is within a specified range.

(3) The common-rail pressure is greater than or equal to a specified value.

(4) A specified time period has elapsed after the last malfunction detection processing.

(5) A specified time period has elapsed after the engine is started.

(6) A coolant temperature is greater than or equal to a specified temperature.

(7) A remaining-fuel quantity of the fuel tank 12 is greater than or equal to a predetermined quantity.

(8) The malfunction flag of the first fuel filter 14 is OFF.

(9) The malfunction flag of the second fuel filter 16 is OFF.

When the answer is NO in S404, the ECU 40 terminates the processing. When the answer is YES in S404, the procedure proceeds to S406 in which a second execution condition flag is turned ON. Then, the procedure proceeds to S408 in which the ECU 70 starts detecting a clogging of the second fuel filter 16.

Figure 5:
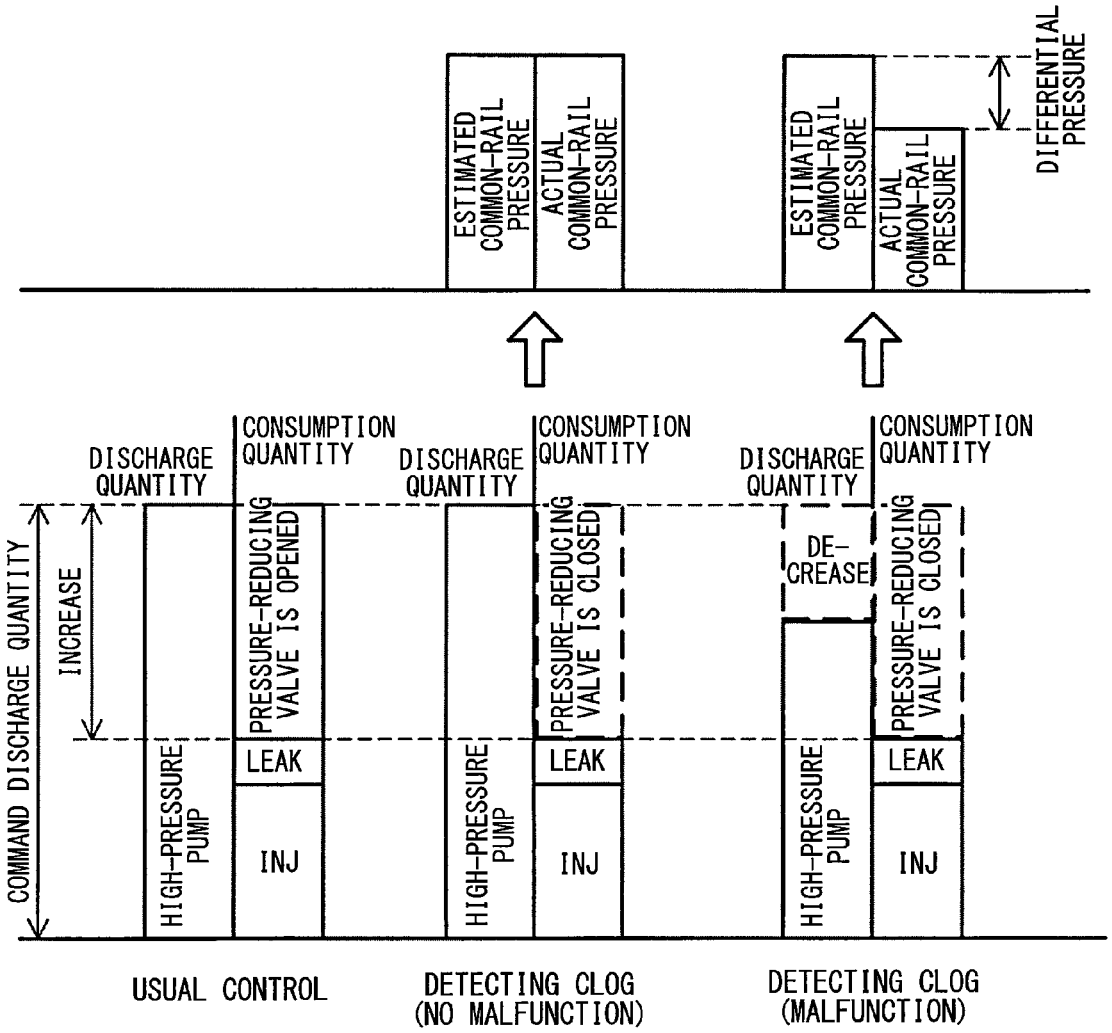
FIG. 5 is a chart showing a relationship between a discharge quantity and a fuel consumption according to a first embodiment.

In a clogging detection performed in S408, as shown in FIG. 5, a discharge-quantity-increase control is executed, whereby a command discharge quantity to the high-pressure pump 40 is increased more than the total of the fuel injection quantity and the leakage of the fuel supply system. The total of the fuel injection quantity and the leakage is referred to as a consumption quantity, hereinafter. The command discharge quantity is increased to an upper limit.

In a usual discharge control, when the command discharge quantity is larger than the consumption quantity, the pressure-reducing valve 64 is opened to discharge the fuel from the common-rail 60, whereby the command discharge quantity agrees with the consumption quantity. Meanwhile, in S408, the ECU 70 increases the command discharge quantity more than the consumption quantity with the pressure-reducing valve 64 closed.

When the pressure-reducing valve 64 is closed and the increased quantity of the command discharge quantity relative to the consumption quantity is not consumed, the common-rail pressure is increased. When the second fuel filter 16 is not clogged, the fuel quantity corresponding to the increased command discharge quantity is supplied to the high-pressure pump 40 through the fuel filter 40. The high-pressure pump 40 discharges the fuel of the command discharge quantity. Therefore, the estimated common-rail pressure obtained from a map agrees with the actual common-rail pressure obtained from the pressure sensor 62.

Meanwhile, when the second fuel filter 16 is clogged, the fuel quantity supplied to the high-pressure pump 40 is decreased relative to the command discharge quantity. Thus, the discharge quantity of the high-pressure pump 40 is decreased more than the command discharge quantity. As a result, since the actual common-rail pressure becomes lower than the estimated common-rail pressure, a differential pressure is generated between the actual common-rail pressure and the estimated common-rail pressure.

Figure 6:
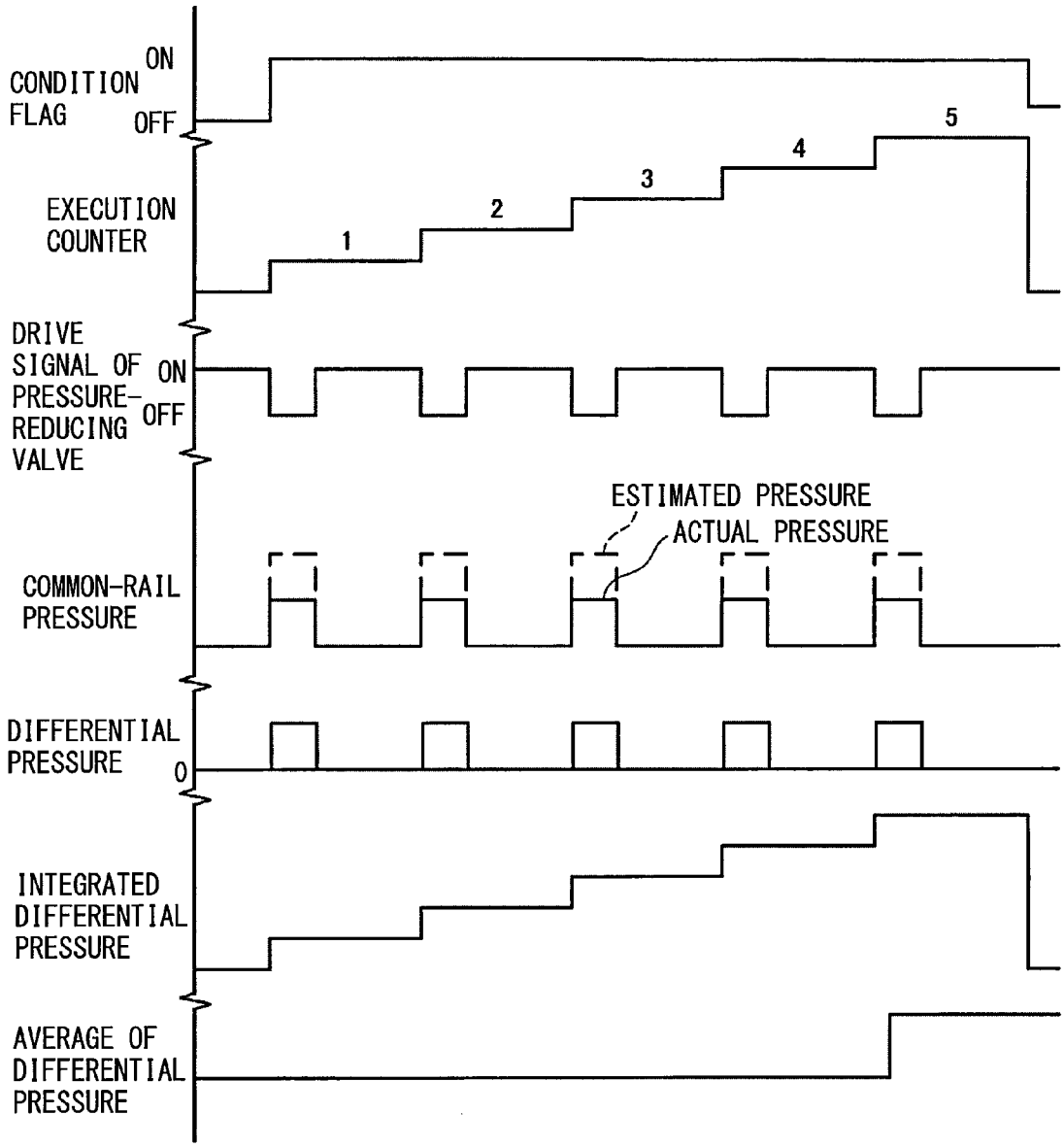
FIG. 6 is a time chart showing a malfunction detection processing.

As shown in FIG. 6, when the second execution condition flag is turned ON, the ECU 70 executes the discharge-quantity-increase control five times in a first clogging detection. After each discharge-quantity-increase control is completed, the ECU 70 opens the pressure-reducing valve 64 to reduce the common-rail pressure which has been increased by the discharge-quantity-increase control.

Figure 7:
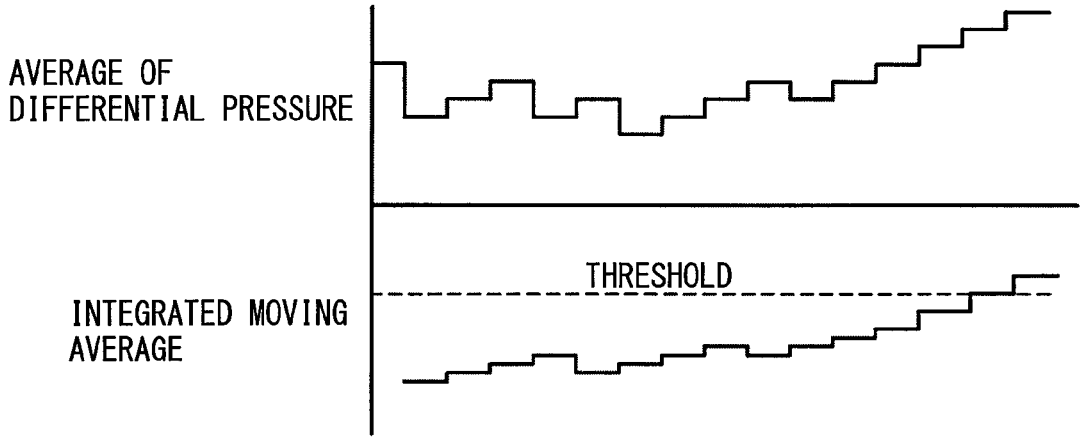
FIG. 7 is a chart showing a relationship between an average of differential pressure and an integrated moving average.

In each discharge-quantity-increase control, the differential pressure between the actual common-rail pressure and the estimated common-rail pressure is computed. Then, an average of the differential pressure of five times is computed. As shown in FIG. 7, the ECU 70 computes an integrated moving average of the averages of the differential pressure. The above described processing is the clogging detection which the ECU 70 executes in S408.

In S410, the ECU 50 determines whether the integrated moving average is greater than or equal to a specified value. When the answer is NO in S410, the ECU 70 determines that the second fuel filter 16 has no malfunction.

When the answer is YES in S410, the ECU 70 determines that the second fuel filter 16 has a malfunction. The procedure proceeds to S412 in which the malfunction flag is turned ON.

According to the first embodiment, the clogging of the second fuel filter 16 is detected by increasing the discharge quantity of the high-pressure pump 40 with the pressure-reducing valve 64 closed. Since the malfunction of the second fuel filter 16 can be detected without decreasing the common-rail pressure, it can be avoided that the injection quantity of the fuel injector 80 is lowered than the target injection quantity.

Furthermore, since the discharge control of the high-pressure pump 40 is executed in such a manner as to increase the pressure loss of the second fuel filter 16, the clogging of the second fuel filter 16 can be accurately detected based on the differential pressure between the actual common-rail pressure and the estimated common-rail pressure.

Moreover, in each discharge-quantity-increase control, after the differential pressure is computed, the pressure-reducing valve 64 is opened to decrease the common-rail pressure. Thus, the time period in which the common-rail pressure deviates from the target common-rail pressure can be shortened much as possible.

According to the first embodiment, a clogging malfunction of the second fuel filter 16 is detected based on the common-rail pressure which the pressure sensor 62 detects. Any sensor other than the pressure sensor 62 is unnecessary to detect the malfunction of the second fuel filter 16.

According to the first embodiment, since a malfunction of the second fuel filter 16 is detected based on the integrated moving average, a noise to the pressure sensor 6 can be reduced. An erroneous determination in malfunction detection can be avoided as much as possible.

Moreover, the malfunction detection processing of the first embodiment is effective for a vehicle of small size and a vehicle of middle size.

Second Embodiment

Figure 8:
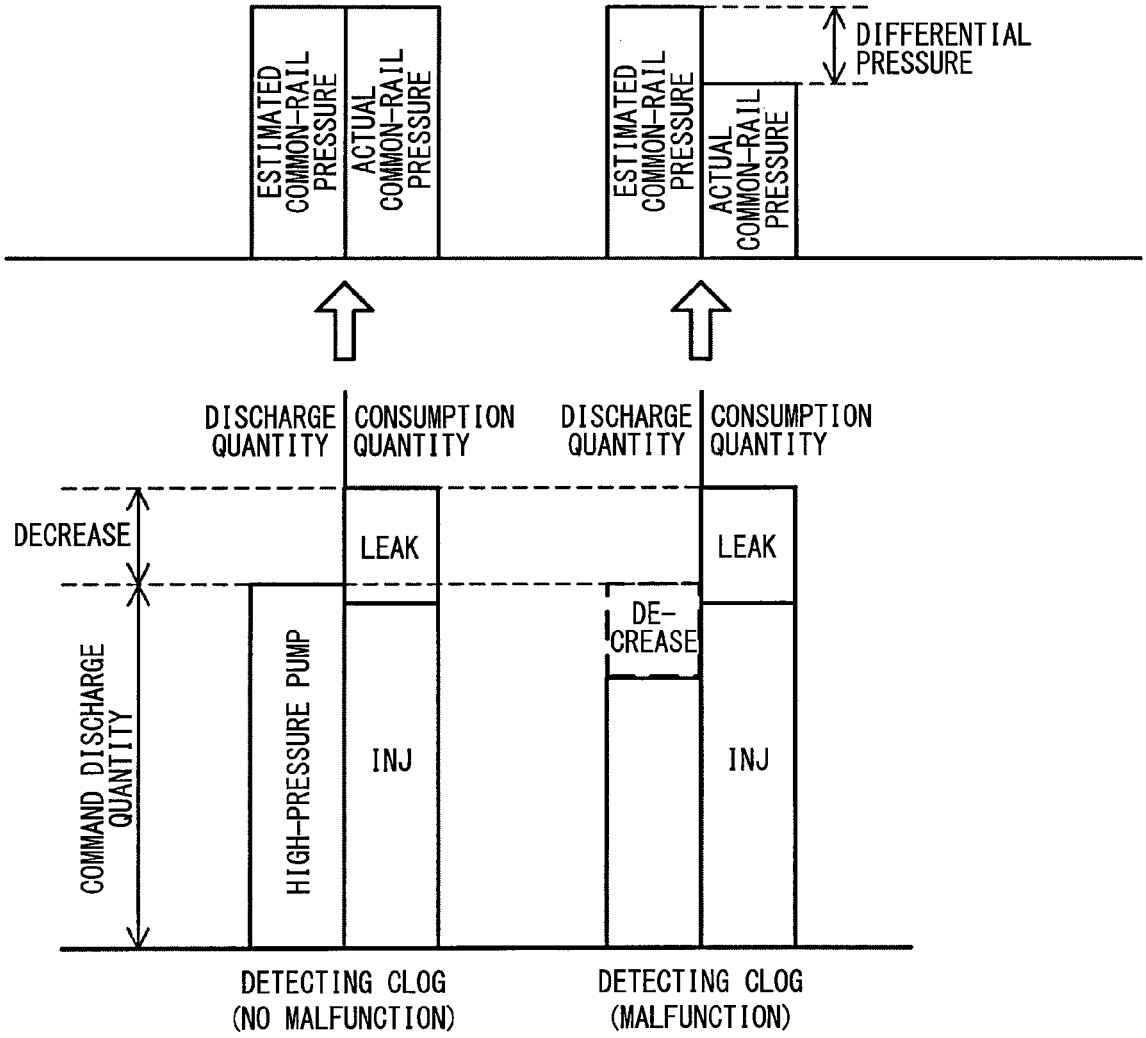
FIG. 8 is a chart showing a relationship between a discharge quantity and a fuel consumption according to a second embodiment.

Referring to FIG. 8, a malfunction detection processing of the second fuel filter 16 will be described according to a second embodiment. In the first embodiment and the second embodiment, the configuration of the fuel supply system 2 is substantially the same. According to the second embodiment, in a malfunction detection processing of the second fuel filter 16, the discharge quantity of the high-pressure pump 40 is decreased to decrease the common-rail pressure.

When the second fuel filter 16 is not clogged, the fuel quantity corresponding to the decreased command discharge quantity is supplied to the high-pressure pump 40 through the fuel filter 40. The high-pressure pump 40 discharges the fuel of the command discharge quantity. Therefore, the estimated common-rail pressure obtained from a map agrees with the actual common-rail pressure obtained from the pressure sensor 62.

Meanwhile, when the second fuel filter 16 is clogged, the fuel quantity supplied to the high-pressure pump 40 is decreased relative to the command discharge quantity. Thus, the discharge quantity of the high-pressure pump 40 is decreased more than the command discharge quantity. As a result, since the actual common-rail pressure becomes lower than the estimated common-rail pressure, a differential pressure is generated between the actual common-rail pressure and the estimated common-rail pressure.

The ECU 70 determines whether the second fuel filter 16 is clogged based on whether the integrated moving average of the average of the differential pressure is greater than or equal to the specified value.

According to the second embodiment, even if the fuel supply system does not have the pressure-reducing valve 64, the ECU 70 can detect a malfunction of the second fuel filter 16.

In each discharge control of the high-pressure pump 40 in which the discharge quantity is decreased for detecting a clogging of the second fuel filter 16, the ECU 70 increases the discharge quantity of the high-pressure pump 40 by adjusting the metering valve 46, whereby the common-rail pressure is increased. The time period in which the common-rail pressure deviates from the target common-rail pressure can be shortened as much as possible.

Furthermore, according to the second embodiment, it is unnecessary to provide another sensor for detecting a malfunction of the second fuel filter 16. A noise to the pressure sensor 62 can be reduced. An erroneous determination in malfunction detection can be avoided as much as possible. The malfunction detection processing of the second embodiment is effective for a vehicle of small size and a vehicle of middle size.

Besides, the high-pressure pump 40 is controlled to decrease its discharge quantity. The pressure loss of the second fuel filter 16 is decreased. Thus, it is preferable that the clogging detection processing is executed when the engine load is relatively high.

The clogging detection can be performed in a fuel flow rate range where the pressure loss of the second fuel filter 16 is relatively high. Thus, based on the differential pressure between the estimated common-rail pressure and the actual common-rail pressure, a clogging of the second fuel filter 16 can be detected with high accuracy.

Other Embodiment

In the first and the second embodiment, a differential pressure sensor is provided to the first fuel filter 14 arranged upstream of the feed pump 30. A malfunction of the first fuel filter 14 can be detected based on the differential pressure. An object of malfunction detection is limited to the second fuel filter 16 arranged downstream of the feed pump 30.

Meanwhile, when no differential pressure sensor is provided to the first fuel filter 14 and a differential pressure sensor is provided to the second fuel filter 16, an object of malfunction detection is the first fuel filter 14. In a case that both fuel sensors 14, 16 are not provided with a differential pressure sensor, a malfunction of at least one of the fuel sensors 14, 16 can be detected according to the first and the second embodiment.

Moreover, in a case that the fuel supply system is provided with one of the fuel filters 14, 16, a clogging can be detected without a differential pressure sensor.

According to the first embodiment, in each discharge-quantity-increase control, the pressure-reducing valve 64 is opened to decrease the common-rail pressure. Meanwhile, the discharge quantity of the high-pressure pump can be decreased by adjusting the metering valve 46.

Thus, also in the fuel supply system which does not have the pressure-reducing valve 64 to the common-rail 60, a malfunction of the second fuel filter 16 can be detected by the discharge-quantity-increase control.

The pressure sensor 62 may be disposed at any position between the high-pressure pump 40 and the fuel injector 80. For example, when the pressure sensor is built in the fuel injector 80, a built-in sensor may detect the fuel pressure.

The fuel-filter malfunction detection device of the present disclosure can be applied to a fuel supply system of a gasoline engine.

The present disclosure is not limited to the embodiment mentioned above, and can be applied to various embodiments.

What is claimed is:

1. A fuel-filter malfunction detection device applied to a fuel supply system which is provided with a high-pressure pump pressurizing a fuel which will be supplied to a fuel injector of an internal combustion engine, a fuel filter arranged upstream of the high-pressure pump for removing a foreign matter from the fuel, a common-rail accumulating the fuel pressurized by the high-pressure pump for supplying the fuel to the fuel injector, and a pressure sensor arranged downstream of the high-pressure pump for detecting a pressure of the fuel which will be supplied to the fuel injector, the fuel-filter malfunction detection condition device comprising:

a discharge control portion increasing or decreasing a discharge quantity of the high-pressure pump when a specified malfunction detection condition is established;

a pressure obtaining portion obtaining a fuel pressure which the pressure sensor detects;

a malfunction determination portion determining whether the fuel filter has a malfunction based on the fuel pressure obtained by the pressure obtaining portion, when the discharge control portion increases or decreases the discharge quantity of the high-pressure pump with a specified malfunction detection condition established;

a pressure decreasing portion decreasing the pressure in the common-rail after the pressure obtaining portion obtains the fuel pressure from the pressure sensor; and a pressure-reducing valve decreasing a fuel pressure in the common-rail, wherein the discharge control portion increases the discharge quantity of the high-pressure pump when the specified malfunction detection condition is established, when a pressure differential pressure between an estimated fuel pressure and an actual fuel pressure is greater than or equal to a specified pressure in a case that the discharge control portion increases the discharge quantity of the high-pressure pump, the malfunction determination portion determines that the fuel filter has a malfunction, the pressure decreasing portion closes the pressure-reducing valve when the discharge control means increases the discharge amount of the high-pressure pump when the specified malfunction detection condition is established, and, the pressure decreasing portions opens the pressure-reducing valve to decrease the fuel pressure in the common-rail when the pressure obtaining means obtains the fuel pressure.

2. A fuel-filter malfunction detection device according to claim 1, wherein in a case that the fuel filter is arranged between the fuel tank and a feed pump supplying the fuel to the high-pressure pump from the fuel tank, another fuel filter is arranged between the feed pump and the high-pressure pump, and only one of the fuel filters is provided with a differential pressure sensor, the malfunction determination portion determines whether the fuel filter provided with no differential pressure sensor has a malfunction based on the fuel pressure of when the specified malfunction detection condition is established, in a case that the fuel filter is arranged at a position between the fuel tank and a feed pump supplying the fuel to the high-pressure pump from the fuel tank, or the fuel filter is arranged another position between the feed pump and the high-pressure pump, and both of filters are provided with no differential pressure sensor, the malfunction determination portion determines whether the fuel filter has a malfunction based on the fuel pressure of when the specified malfunction detection condition is established.

* * * * *